United States Patent [19]

Martinmaas

[11] 4,449,559

[45] May 22, 1984

[54] HAND TOOL WITH HANDLE STORAGE OF INTERCHANGEABLE ELEMENTS

[76] Inventor: Werner W. Martinmaas, 3461 Cashill Blvd., Reno, Nev. 89509

[21] Appl. No.: 300,819

[22] Filed: Sep. 10, 1981

Related U.S. Application Data

[63] Continuation-in-part of Ser. No. 218,435, Dec. 19, 1980, abandoned, which is a continuation of Ser. No. 37,908, May 10, 1979, abandoned.

[51] Int. Cl.[3] ..... B25G 1/08

[52] U.S. Cl. ..... 145/62; 81/438; 81/439

[58] Field of Search ..... 145/62; 81/438, 439

[56] References Cited

U.S. PATENT DOCUMENTS

| | | | |
|---|---|---|---|
| Re. 31,140 | 2/1983 | Martinmaas | 145/62 |
| 273,621 | 3/1883 | Small | 145/62 |
| 366,439 | 7/1887 | Troy | 81/439 |
| 491,189 | 2/1893 | Reinhold | 145/62 |
| 693,123 | 2/1902 | Fairchild | 81/438 |
| 707,901 | 8/1902 | Cheney | 145/62 |
| 1,417,354 | 5/1922 | Scott | 81/438 |
| 2,005,176 | 6/1935 | Arbuckle | 146/62 |
| 3,114,401 | 2/1963 | Johnson | 81/438 |
| 3,590,895 | 7/1971 | Wirtanen | 81/438 |
| 3,667,518 | 6/1972 | Stillwagon | 145/62 |
| 3,935,762 | 2/1976 | Tudisco | 81/438 |
| 4,056,020 | 11/1977 | Coviello | 81/438 |
| 4,235,269 | 11/1980 | Kraus | 145/62 |
| 4,273,173 | 6/1981 | Smith et al. | 145/62 |
| 4,352,307 | 10/1982 | Martinmaas | 145/62 |
| 4,372,361 | 2/1983 | Whiteford | 145/62 |

FOREIGN PATENT DOCUMENTS

| | | | |
|---|---|---|---|
| 1242520 | 6/1967 | Fed. Rep. of Germany | 81/439 |
| 233425 | 10/1944 | Switzerland | 81/439 |
| 403769 | 1/1934 | United Kingdom | 145/62 |

*Primary Examiner*—Frederick R. Schmidt
*Assistant Examiner*—J. T. Zatarga
*Attorney, Agent, or Firm*—Wood, Dalton, Phillips, Mason & Rowe

[57] ABSTRACT

A hand tool such as a socket wrench has a handle with integral means at one end to selectively mount any of a plurality of interchangeable tool elements in the form of socket wrench sockets. Longitudinally extending pockets about the periphery of the handle store extra sockets, and each socket is releasably retained in a pocket and may be removed therefrom by digital manipulation.

5 Claims, 6 Drawing Figures

HAND TOOL WITH HANDLE STORAGE OF INTERCHANGEABLE ELEMENTS

CROSS REFERENCE TO RELATED APPLICATION

This application is a continuation-in-part of my application Ser. No. 218,435, filed Dec. 19, 1980 which in turn was a continuation of my application Ser. No. 37,908, filed May 10, 1979, both abandoned.

BACKGROUND OF THE INVENTION

There have been a number of different structures devised for providing a hand tool such as a screwdriver, chisel or socket wrench with interchangeable elements which are stored on the tool when not in use. Most such tools, however, lack any provision for releasing a single element for use without disturbing others.

Tools which do not suffer from the foregoing disadvantage include those of U.S. Pat. Nos. 3,114,401, 3,667,518, 3,683,984, and my recently issued U.S. Pat. No. 4,253,356. The screwdriver of U.S. Pat. No. 3,114,401 has two blades with double-ended shanks each one of which may be inserted into a socket with either end portion of the blade extending out of the socket for use and the other end portion housed within the socket, and the socket in turn is reversible in a handle and has double-ended blades at both ends.

U.S. Pat. No. 3,667,518 discloses a screwdriver which has several interchangeable blades to be selectively mounted in a socket at one end of the handle, and each blade which is not in use is stored in a shallow longitudinal recess in the handle with an O-ring surrounding the handle in a circumferential groove to retain all the stored blades in place.

U.S. Pat. No. 3,683,984 discloses a hand tool in which extra blades are stored in longitudinal grooves in the handle, with one end of each blade seated in a socket at an end of the groove and the other end of the blade bearing against a compression spring in an opposed socket at the opposite end of the groove. A blade must be moved endwise against the bias of the compression spring to free it from the groove, after which it may be moved radially out of the groove.

My U.S. Pat. No. 4,253,356 discloses a socket wrench in which socket storage means stores a half dozen sockets in a line in such a way that each of the stored sockets may be removed without moving any other socket in the storage means.

Each of the above described prior art devices has some objections which it is the object of the present invention to eliminate.

SUMMARY OF THE INVENTION

The present invention relates to an improvement in a socket wrench, which has a handle and integral means at one end of the handle to selectively mount any of a plurality of interchangeable work-engaging socket elements. The improvement consists in providing the handle with a plurality of longitudinally extending pockets for storing extra elements, and each element is snugly received and stored in a pocket and may be removed therefrom by digital manipulation.

In accordance with the invention a set of two short pockets end-to-end store two socket elements in tandem, with one long pocket for an extension element. A space at each pocket end permits a finger to be inserted into the stored socket element to pry it from the pocket.

THE DRAWINGS

DETAILED DESCRIPTION OF THE INVENTION

Figure 5:
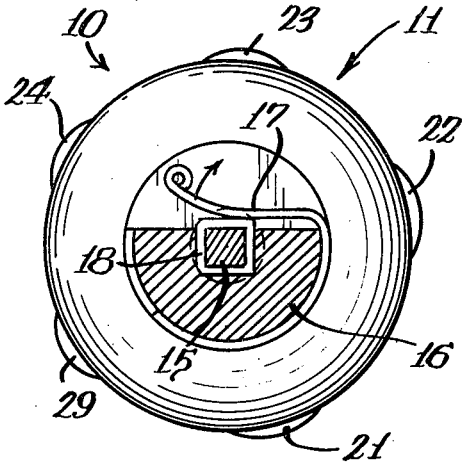
FIG. 5 is a sectional view taken substantially as indicated along the line 5—5 of FIG. 4.

Referring to the drawings in detail, a hand tool, indicated generally at 10, includes a handle, indicated generally at ll, and a socket element mounting means, indicated generally at 12, to which the handle 11 is detachably connected. The socket element mounting means 12 includes a shank 13 which is received in a bore in the handle, and a projecting part 14. A square extremity 15 on the shank 13 is received in a square hole in a cap piece 16 in the upper end of the handle 11, and a spring 17 resiliently engages in a peripheral groove 18 in the square shank extremity 15. The spring 17 may be flexed in the direction of the arrow in FIG. 5 to disengage it from the peripheral groove 18 in order to remove the handle 11 from the mounting means shank 13.

At the outer end of the mounting means shank 12, and projecting laterally therefrom, is a conventional socket wrench ratchet drive 19 on which is a socket element mounting stub 20 provided with a spring-pressed ball **20*a*. The stub 20 may receive any one of eight socket elements, numbered 21 through 28, or an extension element 29. The socket elements 21–28 have respective hexagonal socket 21*a*–28*a*, and they also have end walls with square holes which fit upon the stub 20 or upon a square extremity 29*a* of the extension element 29**.

Figure 1:
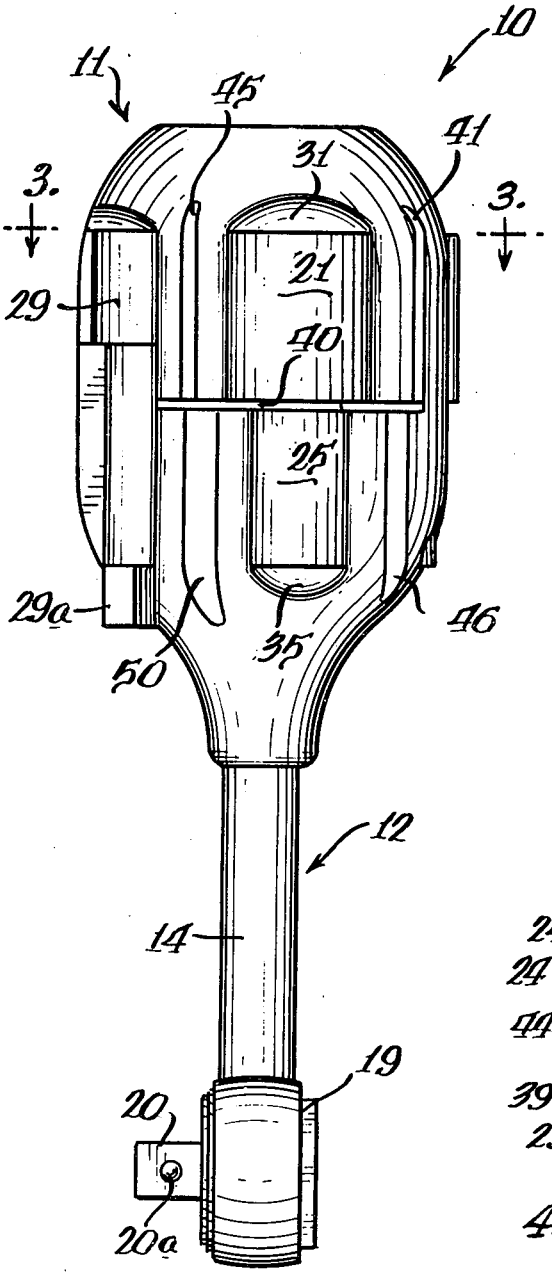
FIG. 1 is a side elevational view of a socket wrench embodying the invention.
Figure 2:
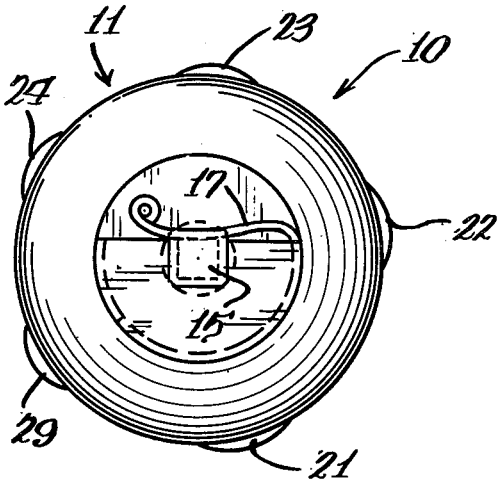
FIG. 2 is an end elevational view looking at FIG. 1 from the top.
Figure 4:
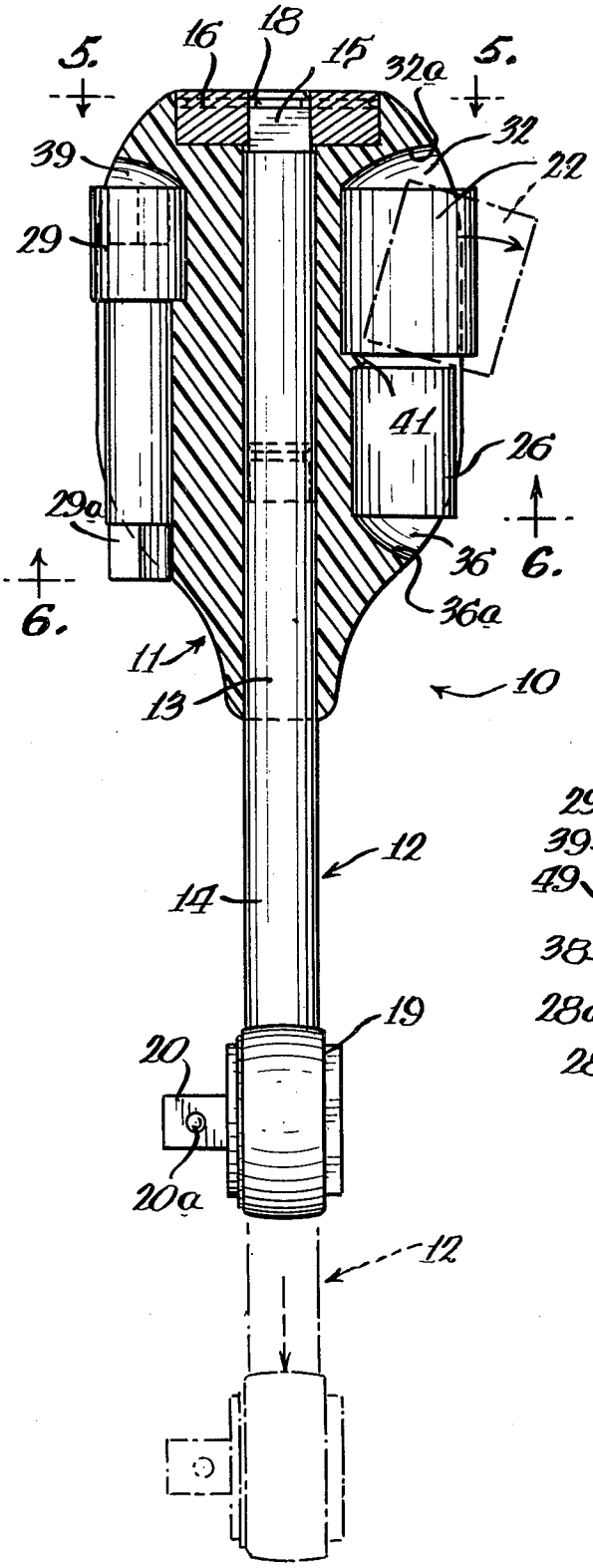
FIG. 4 is a sectional view taken substantially as indicated along the line 4—4 of FIG. 3, with one socket element illustrated in broken lines to show how it is removed, and the tool shank illustrated in broken lines to show how it may be removed from the handle.

The tool handle 11 has longitudinal pockets 31–38 in which the socket elements 21–28 are respectively stored when not in use, and a pocket 39 in which the extension element 29 is stored when not in use. As seen in FIGS. 1 and 4 the pockets 31 and 35 are disposed end-to-end and separated by a partition in the form of a shallow rib 40; and the pockets 32 and 36 are also disposed end-to-end and separated by a partition in the form of a shallow rib. 41. Thus, the socket elements 21 and 25 are stored in tandem on opposite sides of the rib 40; and the socket elements 22 and 26 are stored in tandem on opposite sides of the rib 41. Similarly, the pockets 33 and 37 are arranged end-to-end so as to store the sockets 23 and 27 in tandem and the grooves 34 and 38 are arranged end-to-end to store the sockets 24 and 28 in tandem.

As best seen in FIG. 4, with reference to the socket elements 22 and 26 and their respective pockets 32 and 36, the grooves have respective end portions **32*a* and 36** *a* which are so related to the open hexagonal sockets of the socket elements that a person may insert a finger tip into the hexagonal socket and swing a socket member out of its pocket as illustrated by the arrow and the broken line showing of the socket element 22.

Figure 3:
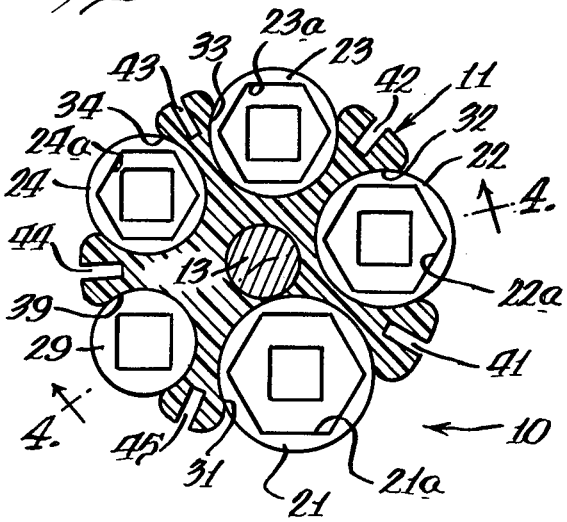
FIG. 3 is a sectional view taken substantially as indicated along the line 3—3 of FIG. 1.
Figure 6:
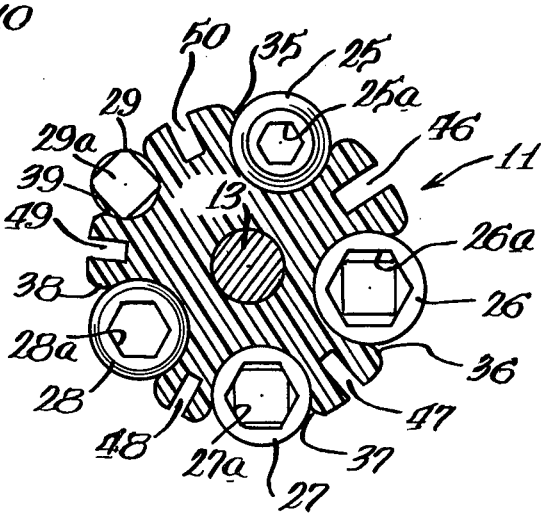
FIG. 6 is a sectional view taken substantially as indicated along the line 6—6 of FIG. 5.

As seen in FIGS. 3 and 6, the handle 11 is longitudinally slit between each adjacent pair of pockets, as indicated by the reference numerals 41–45 in FIG. 3 and the reference numerals 46–50 in FIG. 6. This causes the walls of the pockets to be somewhat resilient, so the socket elements and the extension element snap into the respective grooves and are releasably retained therein by resilient interengagement between the elements and the pocket walls.

The foregoing detailed description has been given for clearness of understanding only and no unnecessary limitations should be understood therefrom as modifications will be obvious to those skilled in the art.

I claim:

1. In a hand tool which has a generally cylindrical handle provided with a bore, and mounting means to selectively mount any of a plurality of interchangeable tool elements, said mounting means including a shank non-rotatably mounted in said bore in the handle, and means at the end of the shank remote from the handle to operatively receive one of said tool elements at a time, the improvement comprising:

the interchangeable tool elements are socket wrench socket elements each of which is cylindrical with a first end portion having an axially extending square drive hole and a second end portion having an axially extending hexagonal socket, said socket elements being of various diameters, all of said drive holes being identical with one another, and all of said hexagonal sockets being of different sizes each of which is adapted to slidably and non-rotatably engage a hexagonal fastener of a predetermined size;

the means to operatively receive said tool elements is a socket wrench ratchet drive with a square mounting stub which projects laterally from the shank and slidably engages in a square drive hole of a socket element;

and the handle has a plurality of longitudinally extending pockets about its periphery for storing all said socket elements, said plurality of pockets being arranged in sets of two pockets which are end-to-end, there is a partition separating the two pockets of each set, and the pockets are of various diameters each of which snugly receives and stores a particular one of the socket elements, each socket element being individually removable by digital manipulation from the pocket in which it is stored.

2. The improvement of claim 1 in which the height and thickness of each partition facilitates digital manipulation of the socket elements stored in the two pockets which are separated by said partition.

3. The improvement of claim 1 or claim 2 which includes a single pocket in the handle that is substantially as long as the two pockets in a set, and an extension element that has a square hole at one end and a square mounting stub at the other end, and said extension element is snugly received and stored in said single pocket.

4. The improvement of claim 1 or claim 2 in which the bore is cylindrical and extends entirely through the handle, the shank of the mounting means is slidable received in and extends substantially entirely through said bore, interengaging parts of the handle and the shank prevent relative rotation between them, and movable means mounted on the handle engages the shank to releasably fix the shank in the bore.

5. The improvement of claim 4 in which the movable means on the handle comprises a spring, there is a peripheral groove in the shank, and the spring is normally engaged in the groove and is released therefrom by digital manipulation.

* * * * *